United States Patent [19]

Schwing

[11] Patent Number: 4,556,370

[45] Date of Patent: Dec. 3, 1985

[54] TWIN CYLINDER PUMPS, MORE SPECIALLY FOR CONCRETE

[75] Inventor: Friedrich Schwing, Herne, Fed. Rep. of Germany

[73] Assignee: Friedrich Wilh. Schwing GmbH, Herne, Fed. Rep. of Germany

[21] Appl. No.: 548,987

[22] Filed: Nov. 7, 1983

[30] Foreign Application Priority Data

Dec. 24, 1982 [EP] European Pat. Off. ..... 82111988.0

[51] Int. Cl.[4] ..... F04B 7/00; F04B 15/02

[52] U.S. Cl. ..... 417/517; 417/519; 417/532; 417/900; 277/164

[58] Field of Search ..... 417/532, 900, 517, 516, 417/519, 518; 277/164

[56] References Cited

U.S. PATENT DOCUMENTS

| | | | |
|---|---|---|---|
| 2,957,717 | 10/1960 | Bram | 277/164 |
| 3,813,105 | 5/1974 | McQueen | 277/164 |
| 4,015,818 | 4/1977 | Tawakol | 277/164 |
| 4,465,441 | 8/1984 | Schwing | 417/517 |

FOREIGN PATENT DOCUMENTS

| | | | |
|---|---|---|---|
| EP52192 | 5/1982 | European Pat. Off. | 417/900 |
| 2614895 | 10/1977 | Fed. Rep. of Germany | 417/900 |
| 2829181 | 1/1980 | Fed. Rep. of Germany | 417/900 |
| 2921735 | 12/1980 | Fed. Rep. of Germany | 417/900 |

*Primary Examiner*—Cornelius J. Husar
*Assistant Examiner*—Peter M. Cuomo
*Attorney, Agent, or Firm*—Price, Heneveld, Huizenga & Cooper

[57] ABSTRACT

A twin cylinder pump for viscous materials such as concrete, having a guide for a cutting ring producing a sealing effect on the cylinder and a seat for supporting a loaded spring ring of elastic material of rubber or the like, is so designed that the ring is acted upon by the pressure of the feed taking effect in the ring-like gap, open as far as supporting face or seat of the spring, between the cutting ring and the valve member. Furthermore there is a guiding and constraining means for the ring taking effect thereon between the radial faces against which it is rested.

8 Claims, 9 Drawing Figures

FIG. 1
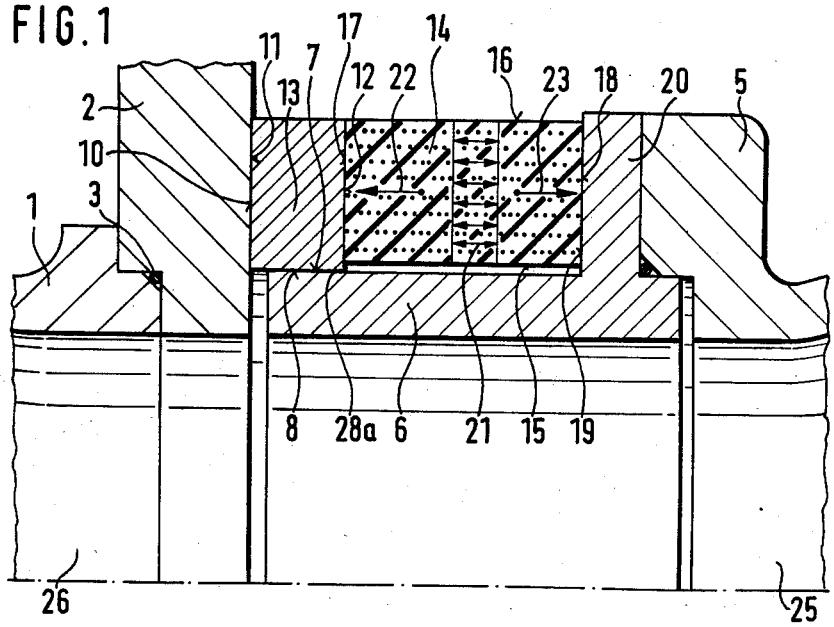
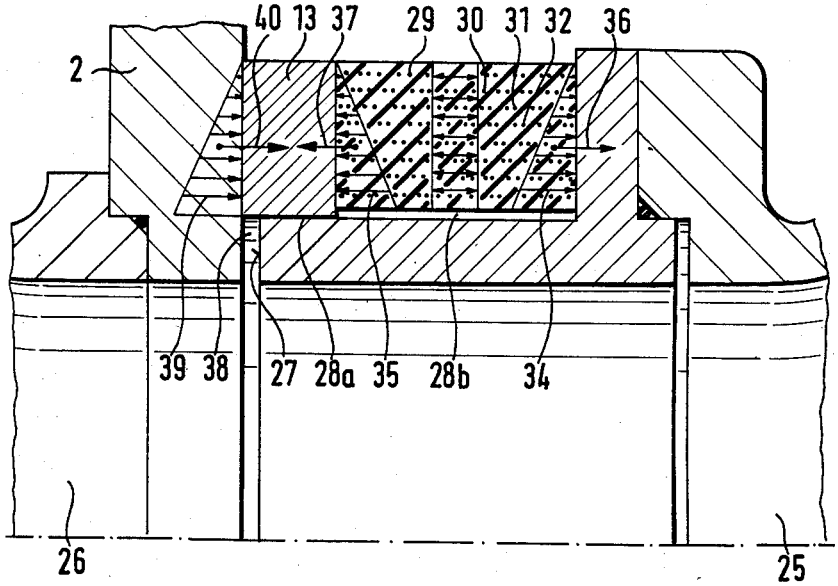
FIG. 2

TWIN CYLINDER PUMPS, MORE SPECIALLY FOR CONCRETE

BACKGROUND OF THE INVENTION

The present invention is with respect to twin cylinder pumps for viscous material, and more specially to such pumps designed for concrete with a valve system in the form of an outside guide for positioning a cutting ring producing a sealing effect on a cylinder and a seat for a loaded ring spring with the elastic properties of rubber.

DISCUSSION OF THE PRIOR ART

In such a pump for viscous material the valve member is moved backwards and forwards in step with the strokes of the pump and at the end positions of such valve member that cylinder which is aspirating is joined up with a pre-filling vessel while the pumping cylinder is joined with the output duct of the pump, the cutting ring pushing out of the way, or breaking, pieces of solid material in the viscous feed, while the valve member is moving. Inasfar as the cutting ring is not moved out of the way of such solids, the guide on the valve member makes this possible, the guide furthermore making it possible for the cutting ring to be adjusted to take up wear of the sealing faces. The cutting ring is responsible for cutting the feed of viscous material from the outside and is best so designed that for sealing it comes up against a plate with two holes lined up with the pumping cylinders. In a system working on these lines heavy forces are produced on the cutting ring moving it in its guide forwards towards the cylinder openings and jamming it against the plate with the two holes.

The present invention may be looked upon in one sense as being a further development of a known design of twin cylinder pump for viscous materials (see the German Offenlegungsschrift specification 3,103,321 more specially FIG. 8) in which the functional gap in the guide between the cutting ring and the valve member is sealed off, the gap opening into a further radial gap between the end face of the valve member and the cutting ring. The hydrostatic pressure at this point keeps the cutting ring pressed against the plate. Furthermore there is a gap between the cutting ring and the plate, that lets off hydrostatic pressure from the metal-on-metal sealing effect of the cutting ring to the outside. The pressure acting in the gap takes effect on the sealing faces so that there is a separating force at this point. As long as such a sealing system is in good working order this separating force is balanced or overcome between the strokes inasfar as the end face (that is acting upon by the pressure of the material being pumped) of the cutting ring is acted upon by this pressure. At the times when the valve member is being moved, in which there is a drop in the hydrostatic pressure for a certain time, the cutting ring is forced against the plate with the openings by the loaded spring so that the cutting ring is kept against the plate in such stages of operation.

To make this possible the seat of the ring spring with rubber-elastic properties is made up of the radial faces on the backside of the cutting ring and on the outer side of the valve member and furthermore takes the form of an axial face (running along the length of the ring spring) on the valve member itself together with short opposite faces parallel thereto on the cutting ring and on the valve member. This design keeps the ring spring, when compressed as far as possible, from being squeezed off its seat by the cutting ring as it is moved into the guide. Between the faces of the seat there is on the outside a large uncovered or free ring spring face.

Under certain working conditions and when the viscous material to be pumped has certain undesired properties, as is likely with concrete and other materials, increased wear has been experienced in such twin cylinder pumps for viscous material so that the valve member is likely to get out of order. Such trouble conditions are caused by the inlet part of the gap between the cutting ring and the plate with the openings becoming stopped up partly or completely by grains of material settling out from the viscous feed, so that there firstly seems to be a sort of blocked filter effect letting off the hydrostatic pressure upstream from the sealing face. The effect is that the load is taken from the cutting ring which otherwise is responsible for separation at the plate with the outcome that, under the effect of the pumping head, its free back end is pressed violently against the plate. This increased mechanical force is quickly responsible for wear on the overloaded sealing faces and for a braking effect so that there is malfunction of the valve member at the time it is being moved.

However, in keeping with another earlier design (see the German Offenlegungsschrift specification 2,614,895) the sealing spring used for sealing the functional gap in the guide of the cutting ring, was to be placed further inwards and to be acted upon by the head of the viscous material. However in this case the sealing ring is not kept in place and guided to the necessary degrees so that it is only because of its radial loading effect that it has the effect of loading the cutting ring and forcing it against the plate between the times at which it is moving. This loading effect is not great enough for sealing the valve member and furthermore pumps for viscous material have to be able to be used not only for producing a hydrostatic head but furthermore for aspiration. When the pump is aspirating or acting as a suction pump it is quite likely for the inner sealing ring to be pulled by the viscous material off its seat and to be swept away with the moving viscous material.

GENERAL OUTLINE OF THE PRESENT INVENTION

One purpose of the present invention is that of making such a further development of the design of a twin cylinder pump for viscous feeds as put forward in the prior art that the force of the cutting ring is limited in all stages of operation to the necessary lower limit for cutting down wear and making operation more completely regular.

For effecting this and further purposes that will become clear on reading further parts of the present specification and claims, such a pump is characterized by the present invention inasfar as the ring spring is placed so that it is acted upon through the ring gap (running as far as the seat of the said spring) between the cutting ring and the valve member by the head of the viscous material and has constraining guide means between the radial seat faces.

Further developments of the invention are claimed in the dependent claims herein.

In keeping wit the present invention all the pressing force of the cutting ring acting on the plate with the openings is handed on by the ring spring by way of its radial seat face (formed on the cutting ring) to the cutting ring. In this respect it is a question not only of the mechanical elastic load of the spring as such but furthermore of the strain transmitted by the pumping pressure, acting in the cylinder gap between the guide head of the valve member and the ring spring, to the last-named, said strain then being transmitted by the said spring to the cutting ring. For this reason there is no longer any ring-like gap (as in the said specification 3,103,321) between the end face of the valve member and the back end face of the cutting ring and in face in the present invention the only way in which the feed is able to make its way into the gap between the cutting ring and the plate and into the cylinder gap between the valve member and the ring spring is a gap between the end face of the valve member and the said plate with the openings.

If the inlet to this gap becomes stopped up with solids from the feed, the effect will for this reason be that at the same time the flow of the feed to the sealing gap and furthermore to the gap between the valve member and the ring spring will be cut off.

The outcome of this is that we will now have a direct and simultaneous connection or relation not only of the hydrostatic pressures between the sealing faces of the cutting ring and of the plate but furthermore of the hydrostatic pressures on the radial seat faces of the ring spring, on the one hand, and the true pumping pressure values on the other. Because this is so the two hydrostatic pressure valves noted, which are dependent on the pump output pressure, will be balanced in every condition of operation whatever the level of the true pump output pressure and whatever the sealing effect of the pieces of solid in partly or completely putting an end to the hydrostatic pressures acting between the sealing faces or at the radial seat faces of the ring spring.

For this reason the cutting ring will be pushed against the plate in every condition of operation generally only by a force equal to the mechanical clamping force of the ring spring.

In the event of the inlet gap being not becoming stopped up by solids with a sealing effect, the pumping pressure in the sealing gap between the cutting ring and the plate and in the ring-like gap between the valve member and the ring spring will take its full effect. The effect of the pump pressure on the ring spring will be such that it will not be possible for it to be bulged out radially because of the constraining guide and the stretching tendency will be turned into axial stretch or expansion so that for this reason there will be a force or pressure component acting axially on the cutting ring towards the plate, if the the other end of the ring spring is supported axially on the valve member. Furthermore the inner space will be sealed off from the outside by the ring spring.

Because of the way it is positioned and because it is cut off from the pumped feed by a cylindrical head of the valve member and it is only acted upon by the hydrostatic pressure of the pumped feed, there will be no more wear caused by flow of the ring spring and no danger of the seal being simply wrenched out of place and swept away in the flowing feed.

One useful effect of the invention is that of completely putting an end to overrapid wear and damage to the faces and parts making sealing contact which otherwise might be caused under certain conditions quite frequently by the stopping up and sealing off of gaps as noted hereinbefore. Furthermore the invention is able to make certain of a completely regular motion of the valve member inasfar as the pressing forces needed for the sealing effect are cut down to generally the same level as the mechanical loading effect of the ring spring.

As part of a development of the invention the guide face on the inner side of the cutting ring is cylindrical, it running as far as the sealing face of the cutting ring. This makes it possible for the supporting length of the cutting ring past the end edge, next to the cylinder, of the valve member, to be kept short to give a parallel increase in the length of the the guide face so that there is no or less danger of the cutting ring being rocked on the valve member.

In keeping with a preferred form of the invention, the guide constraining means for the ring spring is placed within the body of the rubber-elastic material of which the spring is made. The constraining means may take the form of a reinforcing spiral in the spring material or the form of a number of separate rings placed one after the other, such rings or such spiral being made of a fabric or textile threads or, however, of wire.

It is furthermore possible for the inner edges of the radial faces on the ring spring to have sealing lips running in an outward direction axially and forming a functional unit with the ring spring. With this design it is possible to make certain that if the loading (or pre-loading) effect of the ring spring is not great enough, the two radial gaps between the ring spring and its radial seat faces are not acted upon by the same hydrostatic pressure so that the forces would be equal have the effect of canceling each other out. In fact, in this form of the invention the hydrostatic force takes effect only radially on the ring spring and is turned into the axial forces, same forcing the sealing faces on the cutting ring together.

As part of a further outgrowth of the general idea of the present invention, in further forms thereof the constraining guide of the ring spring is placed outside the rubber-elastic material thereof and is not internal as in the forms noted so far, but external.

A detailed account of working examples of the invention will now be given as based on the figures herein.

LIST OF THE DIFFERENT VIEWS OF THE FIGURES

FIG. 1 is a diagrammatic lengthways section through a first example of the invention at one stage of operation as part of a twin cylinder pump for viscous materials.

FIG. 2 is a view on the same lines as in FIG. 1 but in a later or further stage of operation.

DETAILED ACCOUNT OF WORKING EXAMPLES OF THE INVENTION

Figure 3:
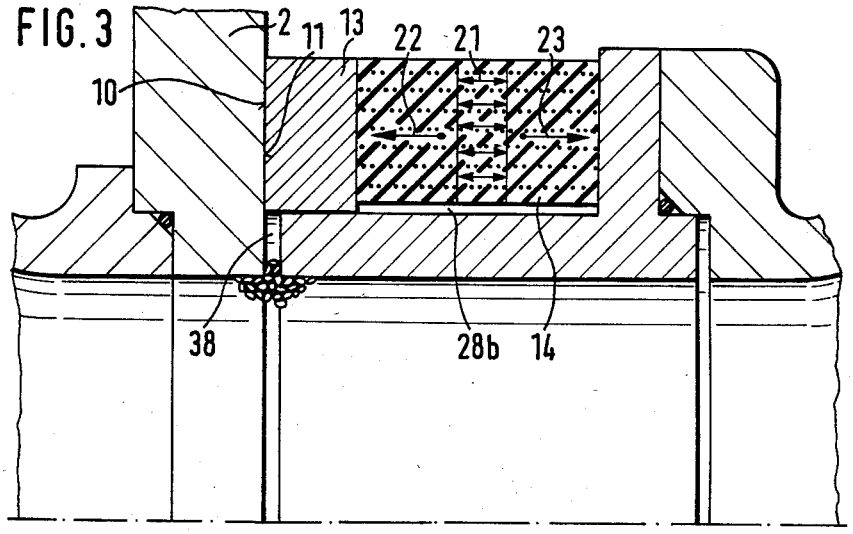
FIG. 3 is a view of the structure in a third stage of operation.

All the structures are to be seen in the figures in cross section, those of FIGS. 1 to 3 and 5 to 7 only being sections through one half of the structure in question.

A twin cylinder pump for viscous material will be seen in FIG. 1 to have a cylinder head 1 that is joined to a plate 2 with two openings, there being a seal at 3 between them. In front of (that is to say on the right of in FIG. 1) there is moving a valve member 5 with a front part 6 that is made so that it may be taken off and replaced when worn. On a front, outer cylindrical face 7 of the valve member 5 there is a cutting ring 13, same having a cylindrical inner face 8 running on the face 7 and its front (left) end face 10 on a mating face 11 of the plate 2. The back or right end face 12 of the ring 13 takes the form of a radial seat face for a ring or annular ring 14 made of a rubber-like and elastic material. This spring has a rectangular cross section whose long sides are the inner and outer ring faces 15 and 16 of the spring, whereas the round end faces 17 and 18 of the ring or annular spring 14 are run up against the radial face 12 of the cutting ring 13 and a radial seat face 19 of a ledge 20 on the valve member 5, said ledge 20 running out past the axial guide face 7 of the valve member.

When the ring spring 14 is put into place it is compressed and loaded axially for loading the ring 13. In FIG. 1 the ring spring forces in this respect are marked at 21, the resultants in each case being marked at 22 and 23. For this reason the cutting ring 13 is pushed or loaded by the force 22 towards the plate 2 to give a sealing pressure at the sealing faces 10 and 11. In the view of FIG. 1 the valve member 5 will be seen in an inbetween position, in which the pressure of the viscous material inside the space 25 of the valve member and in the inner space 26 of the cylinder head 1 has gone down to zero or a low value. The pressing force needed at the sealing faces 10 and 11 is for this reason lower by a parallel amount and the sealing effect may be kept up by the force 22.

This is unlike the condition in FIG. 2 in which in the spaces 25 and 26 the pressure of the feed has increased to be the same as the working pressure in the pump's output duct, that is not figured. This will be the case in the end positions of the valve member, when one of the pump cylinders is joined up with the valve member 5 and the pump output duct.

Between the guide faces 7 and 8 of the valve member 5 and on the cutting ring 13 there is a functional gap **28*a*, that is to say one caused by the way of functioning of the system, such gap being on the one hand open on the seat of the ring spring 14 and on the other hand running as far as the front or left end face 27 of the front part 6. This gap, that may become greater in size so as to be larger than its purely functional size, for this reason takes the form of a connection (joined up with the hydrostatic pressure in the spaces 25 and 26) between the radial gap 38 and a ring or annular gap 28*b* under the ring spring 14 so that the hydrostatic pressure acting at this point is the same as the pressure in the said inner spaces 25 and 26**.

The ring or annular spring is reinforced with piece of steel wire 29, that is coiled helically or in rings in a number of different planes or layers of which some will be seen marked as 30 to 32, same running from the outside to the inside, or from left to right. This steel wire reinforcing element takes the form of a mount or constraining guide within the body of the rubber-elastic material and stopping it from being bulged outwards with a sizeable resistance so that the expansion of the ring spring in a radial direction is greatly limited and the preferential direction of expansion of the said spring is in fact axial. It is because of the rubber-elastic or elastomeric properties of the material of which the ring spring is made that the spring 14 makes a sealing contact with the radial seat faces 17 and 18 so that there is a decrease in the hydrostatic force from the level in the gap **28*b*, such decrease being roughly as marked at 34 and 35 in an outward direction, the resultants 36 and 37 of these hydrostatic forces pressing the cutting ring 13 against the plate 2 with an addition of such forces to the make up the forces 22 and 23** of the mechanical loading (or preloading) effect of the ring spring.

On the other hand there will be a decrease of the hydrostatic pressure from the value in the ring or annular gap 38 between the end face 27 of the valve member 5 and the end face of the plate 2, in an outward direction along the sealing faces 10 and 11 of the cutting ring 13 and of the plate 2 as will be seen by the force line marked at 39, the resultant thereof being the marked at 40. Because it is safe to take it that the forces 35 and 39 will be the same, the outcome is that the cutting ring will, at this stage of operation of the twin cylinder pump for viscous material, be pressed onto the plate with a force equal to the degree to which one of said forces is greater than the other and which is equal to the mechanical loading force 22 of the ring spring. For this reason the sealing effect at the cutting ring 13 will be trouble-free.

In FIG. 3 the reader will see the condition in which the radial gap 38 is being stopped up by a collection of fine grains of solid at and near to the inlet end of the gap. The gap 38 will then become more and more stoppered up so that the hydrostatic pressure in the gap 38 downstream from such fine grains will go down more or less to zero. Because of the open ring gap between the guide faces 7 and 8 for this reason the pressure in the ring gap under the spring 14 will go down as well and the ring spring 14 will only pressed with the force 22 against the cutting ring 13, such force being equal to the loading force 21 of the ring spring. Because on the other hand the hydrostatic forces, which normally go down in value along the sealing faces 10 and 11 because of the effect of the cutting ring 13, will have dropped because of the pressure drop in the ring gap 38, there will be no separating or parting force and, this being the case, the cutting ring will in fact only be pushed against the plate 2 by the resultant force 22.

Figure 4:
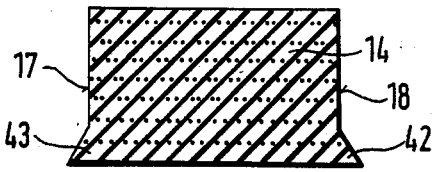
FIG. 4 is a cross section through a ring spring as used in the working example of the invention to be seen in FIGS. 1 to 3.

In order to get a sealing off of the ring spring 14 in keeping with the pressure drop marked at 34 and 35, the spring 14 has two sealing lips 42 and 43 (see FIG. 4 in which the ring spring 14 is to be seen in its unstressed condition), each at one inner edge of its radial faces 18 and 17, such lips 42 and 43 running out axially and forming a single functional unit with the rest of the ring seal or spring 14.

Figure 5:
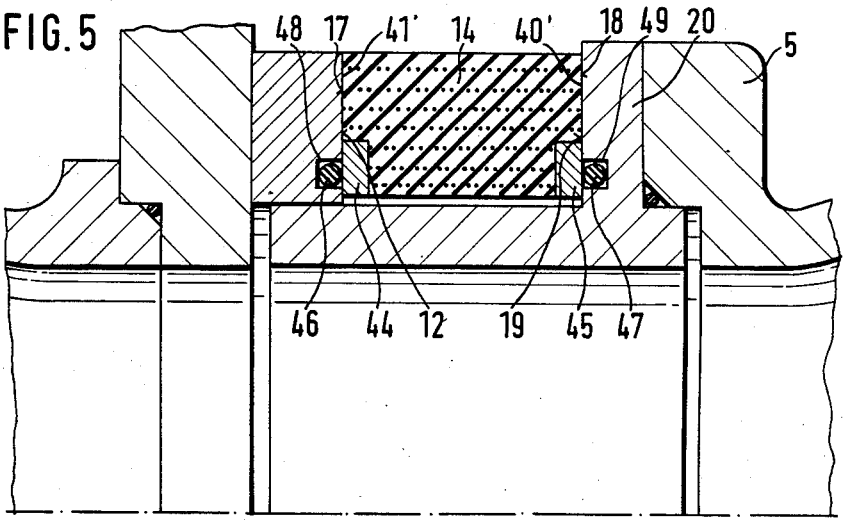
FIG. 5 is a view on the same lines as in FIGS. 1 to 4 of a somewhat changed form of the invention.

In the example of the invention to be seen in FIG. 5 the ring seal or spring 14 will be seen to have steel rings 44 and 45 vulcanized in place at its radial faces near its inner edges. Each such steel ring 44 and 45 has an outward sealing function, it resting against an O-ring 46 and 47, such rings being placed in two separate ring grooves 48 and 49 therefor. The ring grooves are produced in the radial seat faces 12 and 19 of the cutting ring 13 and of the valve member 5 by turning.

Figure 6:
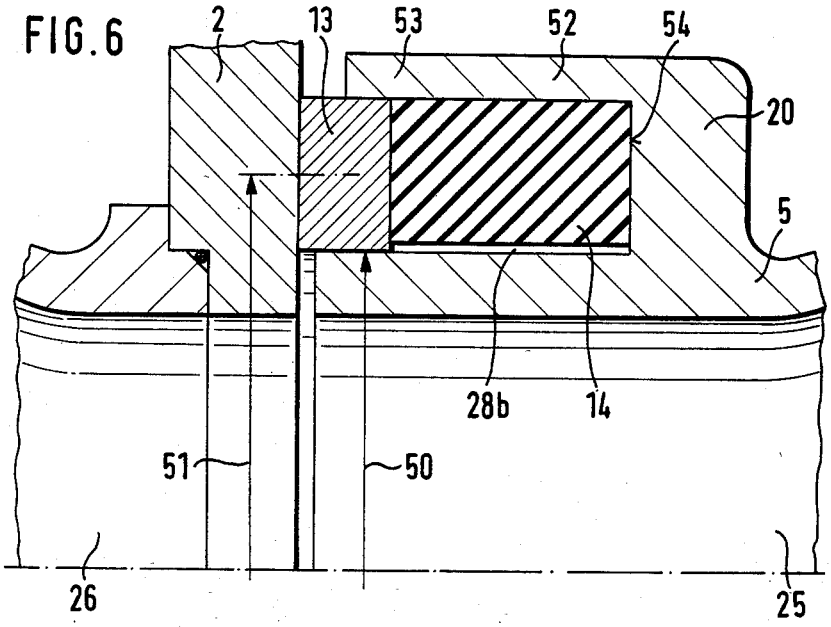
FIG. 6 is a view like that of FIG. 5 but of a form of the invention with further changes.
Figure 7:
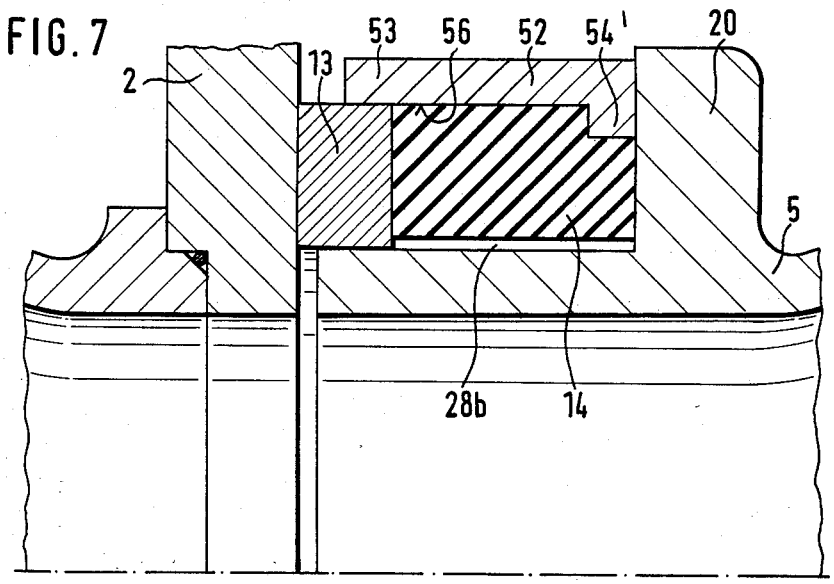
FIG. 7 is a view like those of FIGS. 5 and 6 of the invention with still further changes.
Figure 8:
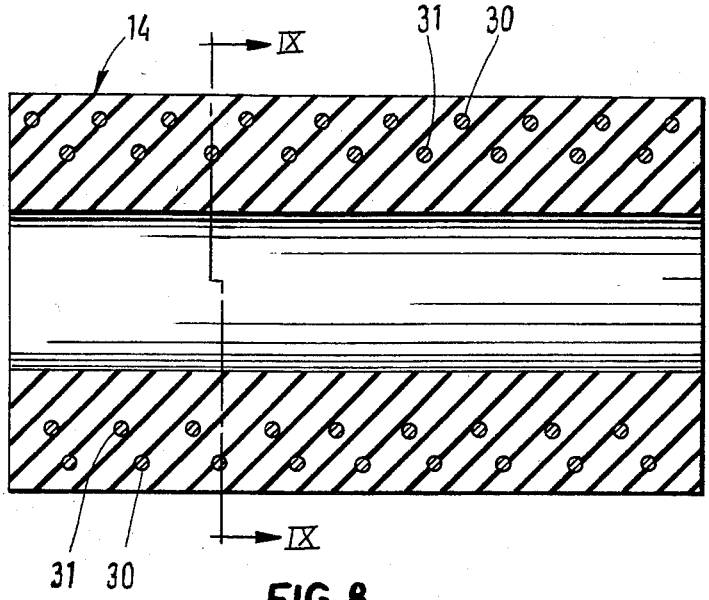
FIG. 8 is a central longitudinal section of the ring spring.
Figure 9:
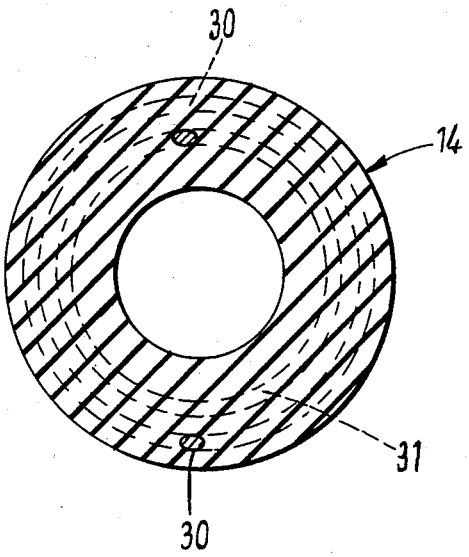
FIG. 9 is a sectional view taken along the plane IX—IX of FIG. 8.

In the further form of the invention to be seen in FIGS. 6 and 7, in which the designs of the ring springs are different to take into account the sealing function of the ring springs, the forces to be seen in FIGS. 1 to 3 have not been marked. However in FIG. 6 the centering diameter 50 of the guide of the cutting ring 13 with the faces 7 and 8 on the valve member 5 has been marked. This centering diameter is markedly less than the acting diameter 51 of the metal seal effect of the cutting ring 13 on the plate 2 as same was marked in FIG. 2 with the hydrostatic pressure of the viscous feed in the spaces 25 and 26. These relations between the diameters are to be seen in all the working examples of the invention. In the form to be seen in FIG. 6 the ring spring 14 is not reinforced and in place thereof the ring ledge 20 on the valve member 5 is made with a greater axial length at 52 forming a guide at 53 with a pocket-like groove to take up the cutting ring 13 without guiding same. In this respect such guiding function is taken over by the faces 7 and 8. This constraining guide 53 is responsible for forming a shut off inner space for the ring spring 14, that for this reason when the pressure in the ring space **28*b* goes up will only be moved towards the cutting ring 13 so that there is then a loading effect on the plate 2**.

The design of FIG. 7 is different to this inasfar as the constraining and guiding means is such that the part or wall 52 is not made of a single functional unit as in FIG. 6 with the ring ledge 20, and in fact the said means is here in the form of a separate part having a ledge 54' resting on the end face of the ledge 20. The ring spring 14 is placed within this wall or sleeve 52 with an inner face 56. The sleeve 52, having its front part fitted round the cutting ring 13, for its part is designed as a constraining and guiding means for the ring spring that only lets expansion of same take place in the axial direction 13 so that when the pressure in the ring space **28*b* goes up the cutting ring 13 is again pressed against the plate 2** with the hydrostatic force.

I claim:

1. A pump for viscous materials said pump having cylinder means and valve means, a cutting ring seated against said cylinder means and effecting a seal therewith, tubular means between said cylinder means and said valve means and extending into said cutting ring for guiding said cutting ring for movement axially thereof, an annular spring of rubber-like material surrounding said tubular means and having one end seated against a face of said cutting ring opposite from said cylinder, said valve means having an annular surface engaging the opposite end of said spring, the valve means being spaced from the cylinder means, an annular gap between said spring and said tubular means; passage means for transmitting hydrostatic pressure from within said cylinder and valve means to said annular gap; constraining means for fixed radial dimension engaging said spring and extending a substantial portion of its length for liminting said spring to axial deflection against said cutting ring and valve means under increased hydrostatic pressure within said annular gap.

2. The viscous material pump as claimed in claim 1 wherein said constraining means includes a pair of wire helices embedded within and having central axes concentric with the axis of the rubber-like material of said spring, said helices being radially spaced within said spring.

3. The viscous material pump as claimed in claim 1 wherein said constraining means is a plurality of discrete wire rings having central axes concentric with the axis of and embedded within said rubber-like material.

4. The viscous material pump as claimed in claim 1 wherein said spring has a body with internal radially inner edges formed with lips extending axially outwardly therefrom and forming a functional unit with said spring body.

5. The viscous material pump as claimed in 1 wherein said constraining means is made up of a cylindrical wall placed round said spring and running axially from a ledge, forming part of said valve member, along said spring and round said cutting ring.

6. The viscous material pump as claimed in 5 wherein said valve member is formed with ledge running round it and having a support face for said spring, said ledge furthermore being formed with said cylindrical wall.

7. The viscous material pump as claimed in 5 wherein said cylindrical wall is made separate from said ledge and is rested against a radial face thereon, said spring of rubber-like material being placed within said wall.

8. A two-cylinder pump for viscous materials said pump having cylinder means and valve means, a cutting ring seated against said cylinder means and effecting a seal therewith, tubular means between said cylinder means and said valve means and extending into said cutting ring for guiding said cutting ring for movement axially thereof, an annular spring of rubber-like material surrounding said tubular means and having one end seated against a face of said cutting ring opposite from said cylinder, said valve means having an annular surface engaging the opposite end of said spring, the valve means being spaced from the cylinder means, an annular gap between said spring and said tubular means; passage means for transmitting hydrostatic pressure from within said cylinder and valve means to said annular gap; constraining means of fixed radial dimension engaging said spring and extending a substantial portion of its length for limiting said spring to axial deflection against said cutting ring and valve means under increased hydrostatic pressure within said annular gap.

* * * * *

UNITED STATES PATENT AND TRADEMARK OFFICE

CERTIFICATE OF CORRECTION

PATENT NO. : 4,556,370

DATED : December 3, 1985

INVENTOR(S) : Friedrich Schwing

It is certified that error appears in the above-identified patent and that said Letters Patent is hereby corrected as shown below:

Column 2, line 64:
"wit" should be --with--
Column 3, line 9:
"face" (second occurrence) should be --fact--
Column 3, line 50:
Delete "the" (first occurrence)
Column 4, line 9:
Delete "the" (first occurrence)
Column 4, line 30:
After "equal" insert --and--
Column 5, line 11:
Delete "moving a" and insert --a moving--
Column 5, line 19:
"ring" should be --spring--
Column 5, line 63:
After "with" insert --a--
Column 6, line 14:
Delete "the" (second occurrence)
Column 6, line 23:
Delete "the" (second occurrence)

UNITED STATES PATENT AND TRADEMARK OFFICE

CERTIFICATE OF CORRECTION

PATENT NO. : 4,556,370

DATED : December 3, 1985

INVENTOR(S) : Friedrich Schwing

It is certified that error appears in the above-identified patent and that said Letters Patent is hereby corrected as shown below:

Column 6, lines 36 and 37:
"stoppered" should be --stopped--
Column 6, line 42:
After "only" insert --be--

Signed and Sealed this

*Twentieth* Day of *May 1986*

[SEAL]

*Attest:*

DONALD J. QUIGG

*Attesting Officer*

*Commissioner of Patents and Trademarks*